United States Patent [19]

Ryan

[11] 4,217,203

[45] Aug. 12, 1980

[54] CONTINUOUS AUTOREFRIGERATIVE DEWAXING PROCESS AND APPARATUS

[75] Inventor: Douglas G. Ryan, Rockaway, N.J.

[73] Assignee: Exxon Research & Engineering Co., Florham Park, N.J.

[21] Appl. No.: 974,072

[22] Filed: Dec. 28, 1978

[51] Int. Cl.[2] ..... C10G 43/08

[52] U.S. Cl. ..... 208/35; 196/14.5

[58] Field of Search ..... 208/35, 33

[56] References Cited

U.S. PATENT DOCUMENTS

| | | | |
|---|---|---|---|
| 2,202,542 | 5/1940 | Voorhees | 208/35 |
| 2,347,809 | 5/1944 | Brandt | 208/35 |
| 3,549,513 | 12/1970 | Woodle | 208/35 |
| 3,658,688 | 4/1972 | Biribauer, et al. | 208/35 |
| 3,720,599 | 3/1973 | Gould | 208/35 |

*Primary Examiner*—Herbert Levine

*Attorney, Agent, or Firm*—E. M. Corcoran; J. J. Allocca

[57] ABSTRACT

A continuous autorefrigerant solvent dewaxing process is disclosed wherein a waxy oil is prediluted with a non-autorefrigerative solvent, such as ketone, preferably a mixture of MEK/MIBK, and then passed, at a temperature above its cloud point, to the top of a chilling zone, which is an autorefrigerant chilling zone operating on a continuous basis, and comprises a vertical, multi-staged tower, operating at constant pressure. In this chilling zone, wax is precipitated from the oil to form a waxy slurry and the so-formed slurry is further chilled down to the wax filtration temperature by stagewise contact with liquid autorefrigerant preferably propylene, which is injected into a plurality of said stages and evaporated therein so as to cool the waxy slurry at an average rate of between about 0.1° to 20° F. per minute with an average temperature drop across each stage of between about 2° and 20° F. Some of the propylene remains in the oil which serves to further dilute and reduce the viscosity of the slurry. The dewaxed oil-containing slurry may then be fed directly to wax filters without having to pass through scraped-surface chillers and filter feed drum.

14 Claims, 4 Drawing Figures

CONTINUOUS AUTOREFRIGERATIVE DEWAXING PROCESS AND APPARATUS

BACKGROUND OF THE INVENTION

1. Field of the Invention

This invention relates to a process for solvent dewaxing waxy oils. More particularly, this invention relates to a continuous, solvent dewaxing process and apparatus wherein a waxy oil is prediluted with a non-autorefrigerative dewaxing solvent, with the prediluted oil, at a temperature above its cloud point, being then fed to a chilling zone comprising a vertical, staged tower operating continuously at essentially constant pressure. In the chilling zone wax is precipitated from the oil to form a waxy slurry and the so-formed slurry is further cooled down to wax filtration temperature by contact with a liquid autorefrigerant injected into a plurality of said stages, said liquid autorefrigerant evaporating in each of said stages so as to maintain an average slurry cooling rate of from 0.1° to 20° F. per minute and an average temperature drop per stage of from about 2° to 20° F. The dewaxed oil-containing slurry is then fed to wax filters. This process is particularly useful for dewaxing wax-containing lubricating oil fractions and the like.

2. Description of the Prior Art

It is well known in the art to dewax wax-containing hydrocarbon oils, particularly the lube oil fractions of petroleum oil, in order to remove at least a portion of the wax therefrom to obtain a dewaxed oil of reduced cloud and pour points. The most common method of removing the wax or waxy constituents from waxy hydrocarbon oils is via the use of various solvent dewaxing processes. In solvent dewaxing processes the temperature of the wax-containing oil is lowered sufficiently to precipitate the wax therefrom as solid crystals of wax. At the same time, solvents are added to the waxy oil in order to improve the fluidity and reduce the viscosity thereof so that various filtration or centrifugation processes can be used to separate the solid particles of the wax from the dewaxed oil. Strong wax antisolvents (weak oil solvents) such as MEK are often added to decrease wax solubility in the oil/solvent mixture while strong oil solvents (weak wax antisolvents) such as MIBK or toluene are used to modify the solubility characteristics of the solvent so as to allow wax precipitation, while at the same time avoiding oil immiscibility at wax separation temperatures. Solvent dewaxing processes produce what is known as a pour-filter temperature spread. This is the temperature differential between the wax filtering temperature and the pour point of the dewaxed oil. This pour-filter temperature spread is greater when more non-polar hydrocarbon solvents are used than with more polar solvents such as ketones. Thus, an autorefrigerant dewaxing process employing propane can produce a pour-filter spread of 40° F., which means that the wax filtration must be done at −40° F. in order to produce a dewaxed oil having a pour point of 0° F. When ketones or mixtures of ketone and aromatic solvents are used, the pour-filter spread may range from 0° F. to 20° F. depending on the oil and solvent used.

Commercially successful processes employing autorefrigerative cooling, wherein the waxy oil is mixed with a liquid autorefrigerant which is permitted to evaporate thereby cooling the oil by the latent heat of evaporation, are batch or semi-batch operations. This mixture of liquid autorefrigerant and oil are introduced into an expansion chamber wherein the pressure is slowly reduced to achieve controlled evaporation of the autorefrigerant and controlled cooling of the oil, thus avoiding the shock chilling which would result if the autorefrigerant were allowd to flash off. However, batch processes are cumbersome, difficult to operate and energy inefficient.

A number of attempts have been made to develop a continuous autorefrigerant process for dewaxing oils, including combinations of ketone/autorefrigerant processes. Thus, U.S. Pat. No. 3,549,513 discloses an autorefrigerative batch dewaxing process that is described as continuous, but which really operates via the sequential use of a multiple number of batch chillers or expansion chambers. Waxy oil is diluted with an aromatic/ketone solvent mixture and with liquid autorefrigerant and cooling is achieved by controlled evaporation of the autorefrigerant by reducing the pressure in each batch chamber in a manner such that the autorefrigerant evaporates at a controlled rate. U.S. Pat. No. 3,658,688 discloses an autorefrigerant dewaxing process wherein a portion of the wax is precipitated from the oil in a DILCHILL* dewaxing tower wherein the cooling occurs by the injection of cold autorefrigerant into the tower to produce to waxy slurry, followed by autorefrigerative cooling of the slurry in batch chillers. U.S. Pat. No. 2,202,542 suggests a continuous autorefrigerant dewaxing process wherein a waxy oil above its could point is premixed with warm, liquid propane. This mixture is introduced into a multi-staged cooling tower and liquid $CO_2$ is injected into each stage out of direct contact with the oil. This patent emphasizes the point that the liquid $CO_2$ must be introduced into each stage out of direct contact with the oil in the tower in order to avoid shock chilling. However, this is impractical because the vapor loads on the tower would be far in excess of what could be accommodated in a reasonably sized commercial tower. Also, refrigeration requirements are three times those normally needed and conditions for nucleation and growth of wax crystals are poor. U.S. Pat. No. 3,720,599 discloses a continuous process for dewaxing a waxy petroleum oil stock wherein the oil is premixed with acetone. This mixture is then introduced into a horizontal, elongated chilling vessel containing a plurality of stages operating at different pressures, with the pressure in each stage controlled by a back pressure regulator on each stage. Liquid autorefrigerant is introduced into the stages along the length of the chilling vessel while maintaining a high degree of agitation therein to avoid shock chilling. The autorefrigerant is partially evaporated in each stage, with the amount of evaporation being controlled by the pressure in each stage. Unfortunately, there are problems which currently preclude commercialization of this process, not at least of which is a practical, efficient way of getting the slurry to flow from stage to stage without plugging up the entire apparatus with wax or without multiple transfer pumps which would be expensive and would also tend to destroy the wax crystal structure. Another disadvantage entails the impracticality of providing separately driven agitators for each stage and the mechanical difficulties associated with a common horizontal drive shaft.

Registered service mark of Exxon Research and Engineering Co.

It would be an improvement to the art if one could devise an autorefrigerant solvent dewaxing process that operates in a continuous manner and without the need for mechanical agitators or chambers controlled at separate pressure levels in the chilling zone or tower.

SUMMARY OF THE INVENTION

What has now been discovered is a continuous autorefrigerant process and apparatus for solvent dewaxing waxy oils which comprise the steps of:

(a) prediluting the waxy oil with a non-autorefrigerant dewaxing solvent to form a mixture of waxy oil and solvent;

(b) passing said mixture from step (a), at a temperature above its cloud point, into the top of a continuous, autorefrigerative chilling zone which comprises a vertical, elongated, multi-staged tower operating at a constant pressure wherein each stage contains a liquid space and a vapor space above the liquid space, each of said vapor spaces also containing means for removal of autorefrigerant vapor therefrom;

(c) cooling said mixture as it passes down from stage to stage in said chilling zone to precipitate wax from said oil thereby forming a slurry comprising solid particles of wax and a dewaxed oil/solvent solution and further chilling the so-formed slurry by contacting same, in said chilling zone, with a liquid autorefrigerant which is introduced under flow rate control conditions into a plurality of the stages in said zone and allowed to evaporate therein so as to achieve an average cooling rate of the slurry in said zone ranging from between about 0.1° to 20° F. per minute with an average temperature drop across each stage into which said liquid autorefrigerant is introduced and evaporated ranging from between about 2° to 20° F. and wherein the evaporated autorefrigerant is removed from each of said stages into which said liquid autorefrigerant was injected in a manner such that the autorefrigerant vapor formed in any given stage does not pass through the slurry on all of the stages in the tower above said stage; and (d) separating the wax from the slurry to obtain wax and a dewaxed oil solution.

In a preferred embodiment of this invention, the prediluted oil will contain a dewaxing aid and will be introduced into the top of the chilling zone at a temperature at or near its cloud point and the slurry will be chilled down to the wax filtration temperature in said chilling zone.

The "could point" of the oil is defined as a temperature at which a cloud or haze of wax crystals first appears when an oil is cooled under prescribed conditions (ASTM D-2500-66 procedure). "Predilution," as the term is used herein, refers to the mixing of solvent and oil prior to cooling the oil to a temperature below its depressed cloud point and comprises, in one embodiment of this invention, prediluting a waxy oil with at least about 0.5 volumes of a non-autorefrigerative predilution solvent per volume of oil stock resulting in the depression of the cloud point of the oil stock so as to effect substantially instantaneous mixing of the solvent and wax/oil mixture as they progress through said zone.

The non-autorefrigerative dewaxing solvent employed as predilution solvent in this invention includes one or more (a) aliphatic ketones having from 3–6 carbon atoms, such as acetone, methyl-ethyl ketone (MEK), methyl-isobutyl ketone (MIBK), methyl-propyl ketone and mixtures thereof, (b) halogenated low molecular weight hydrocarbons such as $C_2$–$C_4$ alkyl chlorides (e.g., dichloromethane, dichlorethane, methylene chloride) and mixtures thereof, (c) normal or isoparaffins having 5 to 10 carbon atoms, (d) aromatics such as benzene, toluene, xylene, petroleum naphtha and mixtures thereof, and (e) mixtures of any of the foregoing solvents. Non-autorefrigerant solvent as herein defined may include up to 25 LV % of autorefrigerant solvent, preferably not more than 10 LV % and still more preferably not more than 5 LV %, but most preferably no autorefrigerants at all. For example, the ketones are often used in combination with one or more aromatic compounds such as benzene, toluene, xylene and petroleum naphtha. Preferred solvents comprise ketones. Particularly preferred are mixtures of MEK and MIBK or MEK and toluene. Autorefrigerants used in this invention include liquid, normally gaseous $C_2$–$C_4$ hydrocarbons such as propane, propylene, ethane, ethylene and mixtures thereof as well as ammonia and normally gaseous chloro fluorocarbons such as monochlorodifluoromethane (Freon 22). Autorefrigerative solvent as herein defined may contain up to about 50 LV % of non-autorefrigerative solvent, preferably no more than 10 LV % and preferably no more than 2 LV %.

The chilling zone is a vertical, elongated, multi-staged tower operating at a constant pressure and in a manner such that the waxy oil and slurry pass down from stage to stage of the tower by gravity and cold, liquid autorefrigerant is injected into each stage of the tower wherein it contacts the warmer oil or slurry and cools same via autorefrigerative evaporation. At least a portion of the cold, liquid autorefrigerant immediately evaporates on contact with the warmer oil or slurry which results in agitation in the area of contact sufficient to achieve substantially instantaneous mixing (i.e., about one second or less of the oil or slurry with the cold liquid autorefrigerant, thus avoiding the shock chilling effect. As hereinbefore stated, supra, each stage contains means for removing the autorefrigerant vapors therefrom and the slurry flows down from stage to stage in the tower by the action of gravity. The cooled slurry exiting this chilling zone is then passed to means, such as rotary pressure filters, for separating the wax from the dewaxed oil/solvent mixture.

In general, this chilling zone or tower will operate at a constant pressure within the range of from about 0 to 50 psig and more preferably from about 2 to 20 psig. The average chilling rate in the tower is the difference between the temperature of the prediluted oil entering the tower and the temperature of the slurry exiting the tower divided by the residence time of the oil or slurry in the tower and will range from about 0.1° to 20° F./minute and more preferably from about 0.5° to 10° F./minute. This is achieved by controlling the autorefrigerant flow rate into, and oil hold-up in, each stage, rather than by gradually decreasing the pressure in the system as is done in batch chillers. That is, a controlled quantity of autorefrigerant is vaporized in direct contact with a controlled quantity of oil or slurry in each stage of the tower. This is accomplished by injecting the liquid autorefrigerant through spray nozzles either submerged in the slurry or above the surface thereof in each stage of the tower under flow rate control conditions. This in turn controls the temperature drop for each stage which will range from about 2° to 20° F. The stagewise chilling rate then depends on the liquid holdup or residence time for each stage. The autorefrigerant evaporates and cools the oil primarily by its latent heat of vaporization which results in an extremely high heat transfer rate. The autorefrigerant vapor is withdrawn from each stage in a manner so as to avoid vapor overload in the tower. In a preferred embodiment, this is done by separately removing the vapor from the vapor space of each stage directly through and outside of the cooling zone or tower, rather than allowing the vapor to cumulatively pass up through each upper, successive stage, as is disclosed in the prior art. However, under certain circumstances, it may be advantageous to allow the vapor produced in one or more given stages to pass up through the tower or cooling zone through some, but not all, of the stages above said one or more given stages before removing the then cumulative vapor from the cooling zone or tower. By way of illustration, it may be advantageous to remove vapor from the zone or tower at every second, third or fourth successive stage. An amount of autorefrigerant is added per stage to give a stagewise temperature decrease ranging from 2° to 20° F., and more preferably from 3° to 10° F. Of course, the ultimate temperature to which the slurry is cooled in this tower will depend on the temperature of the prediluted oil as it enters same, the liquid hold-up in each stage, the amount, type and temperature of autorefrigerant injected into each stage as well as the pressure in the tower and the number of stages in the tower. Therefore, it is understood, of course, depending on the feed and size of the tower, that it may not always be necessary to inject liquid autorefrigerant into each and every stage of the tower. The cooling zone will, in general, cool the slurry down to a temperature ranging from between about 10° to 40° F. and, more preferably, 15° to 30° F. below the desired pour point of the dewaxed oil.

Any waxy petroleum oil stock or distillate fraction thereof may be dewaxed employing the process of this invention. Illustrative, but non-limiting examples of such stocks are (a) distillate fractions that have a boiling range within the broad range of 500° F. to about 1300° F., with preferred stocks including a lubricating oil and specialty oil fractions boiling within the range of between about 560° F. and 1200° F., (b) heavy feedstocks containing at least about 10 wt. % of residual material boiling above 1050° F., examples of which include bright stocks and deasphalted resids having an initial boiling point of above about 800° F. and (c) broad cut feedstocks that are produced by topping or distilling the lightest material or for crude oil leaving a broad cut oil, the major portion of which boils above about 500° F. or 650° F. Additionally, any of these feeds may be hydrocracked prior to distilling, dewaxing or topping. The distillate fraction may come from any source such as the paraffinic crudes obtained from Aramco, Kuwait, the Panhandle, North Louisiana, etc., naphthenic crudes such as Tia Juana, Coastal crudes, etc., as well as the relatively heavy feedstocks such as bright stocks having a boiling range of 1050+° F. and synthetic feedstocks derived from Athabasca Tar Sands, coal liquids, etc.

In a preferred embodiment wherein mixtures of MEK and MIBK are used as the non-autorefrigerant predilution solvent, MEK to MIBK ratios may vary from 90% MEK/10% MIBK to 10% MEK/90% MIBK and more preferably from 70% MEK/30% MIBK to 70% MIBK/30% MEK. Ketone to oil volume ratios may vary from 0.5/1 to 10/1 and more preferably from 1.0/1 to 4/1.

When propylene is used as the autorefrigerant in the chilling zone, from about 0.2 to 2.5 volumes of propylene per volume of waxy oil and more preferably from about 1.0 to 2.0 volumes per volume are used, to reduce the temperature of the slurry down to the wax filtration temperature, and to reduce the viscosity of the slurry sufficiently for wax filtration. Chilling rates in the chilling zone will generally range from about 0.1° to 20° F./min. and more preferably from about 0.5° to 10° F./min. The temperature of the cold slurry exiting the chilling zone may vary from about −50° F. to +30° F. to produce a dewaxed oil having a pour point ranging between about −30° F. to +80° F. In a preferred embodiment, the slurry will exit the chilling zone at a temperature of from −30° F. to +10° F. in order to produce a dewaxed oil having a pour point ranging from between about −10° F. to +30° F.

DESCRIPTION OF A PREFERRED EMBODIMENT

Figure 1:
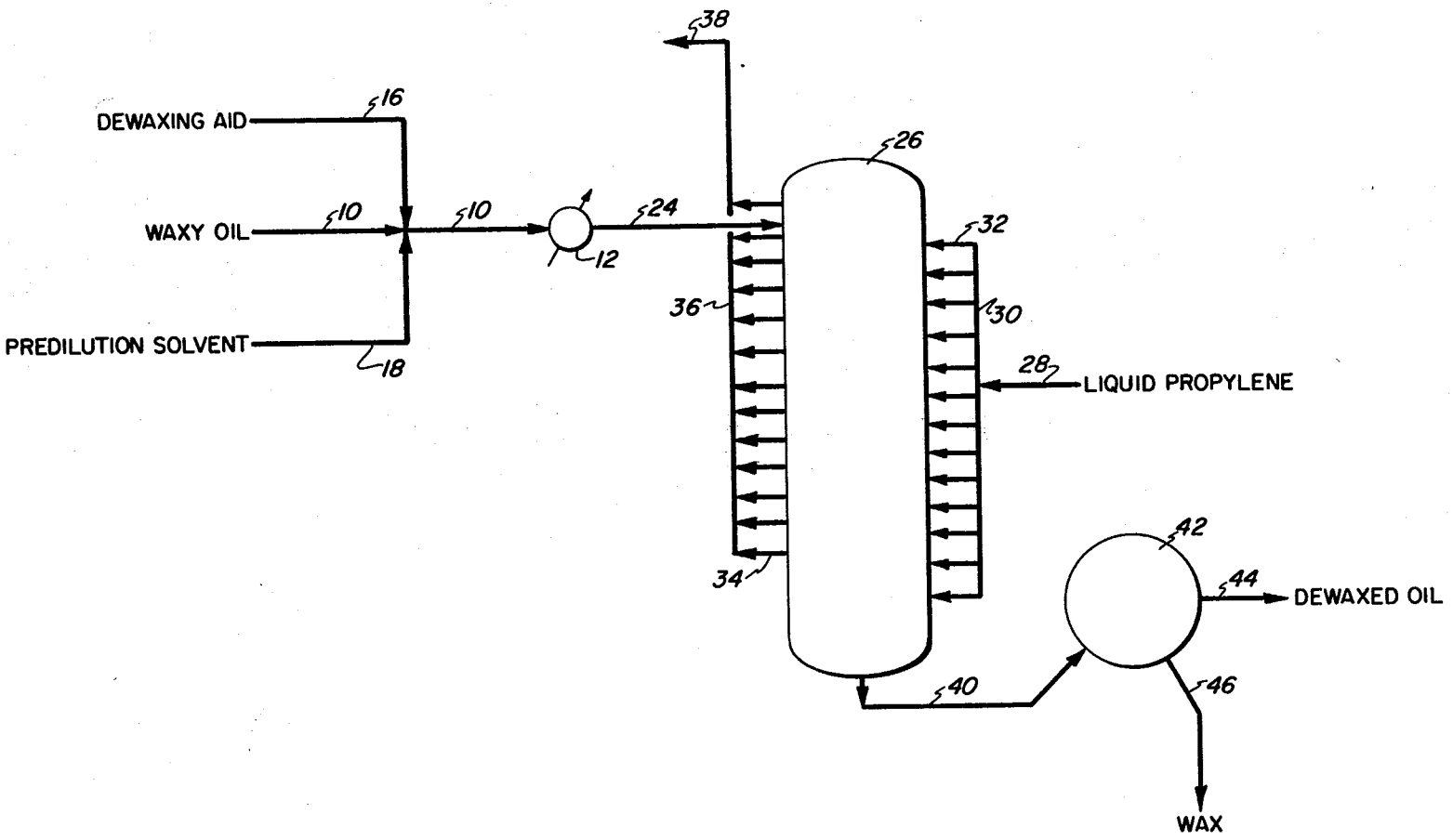
FIG. 1 is a flow diagram of a preferred embodiment of a process incorporating the instant invention.

Referring to FIG. 1, a warm paraffinic lube oil distillate at a temperature of about 160° F. and having a viscosity of 150 SUS at 100° F. is mixed with dewaxing aid from line 16 and then prediluted with a solvent from line 18 comprising a 70/30 volume mixture of MEK/-MIBK in an amount of about 1.2 volumes of ketone predilution solvent per volume of waxy oil. The prediluted waxy oil/dewaxing aid mixture is then passed from line 10 through heat exchanger 12 wherein it is cooled to a temperature of about 90° F. or just above its cloud point and from there into multi-staged autorefrigerant chilling tower 26. Liquid propylene at a temperature of −30° F. is fed into the various stages of tower 26 via line 28, manifold 30 and multiple injection points 32. Multiple injection points 32 are fed to each of the various stages in tower 26 wherein the liquid propylene contacts the slurry in each stage via a sparger located under the surface of the slurry in each stage. About 1.5 volumes of liquid propylene are used in tower 26 per volume of slurry entering therein via line 24. Tower 26 operates at a pressure of about 2 psig. About 1.2 volumes of the liquid autorefrigerant per volume of fresh feed evaporates upon contact with the slurry, with the autorefrigerant vapors being removed from each stage via multiple tower exit ports 34, manifold 36 and line 38 at an average temperature of about 24° F. Thus, none of the vapor produced in any stage passes through the slurry on any other stage in the tower. The remaining 0.9 volumes of propylene per volume of feed go into solution with the MEK/MIBK and dewaxed oil in the wax slurry. Tower 26 contains approximately 14 stages in which the average slurry chilling rate is about 3° F. per minute with an average temperature drop across each stage of about 8.6° F. The waxy slurry is further cooled in tower 26 to a temperature of about −30° F. The slurry comprising solid wax particles, oil, ketone and liquid propylene is then fed to rotary pressure filter 42 via line 40 wherein the wax is filtered from the dewaxed oil solution. The dewaxed oil solution leaves filter 42 via line 44 and from there is sent to solvent recovery while the wax is removed via line 46 and sent to solvent recovery and further wax processing if desired. The dewaxed oil solution yields a dewaxed oil having a pour point of about −10° F.

Figure 2A:
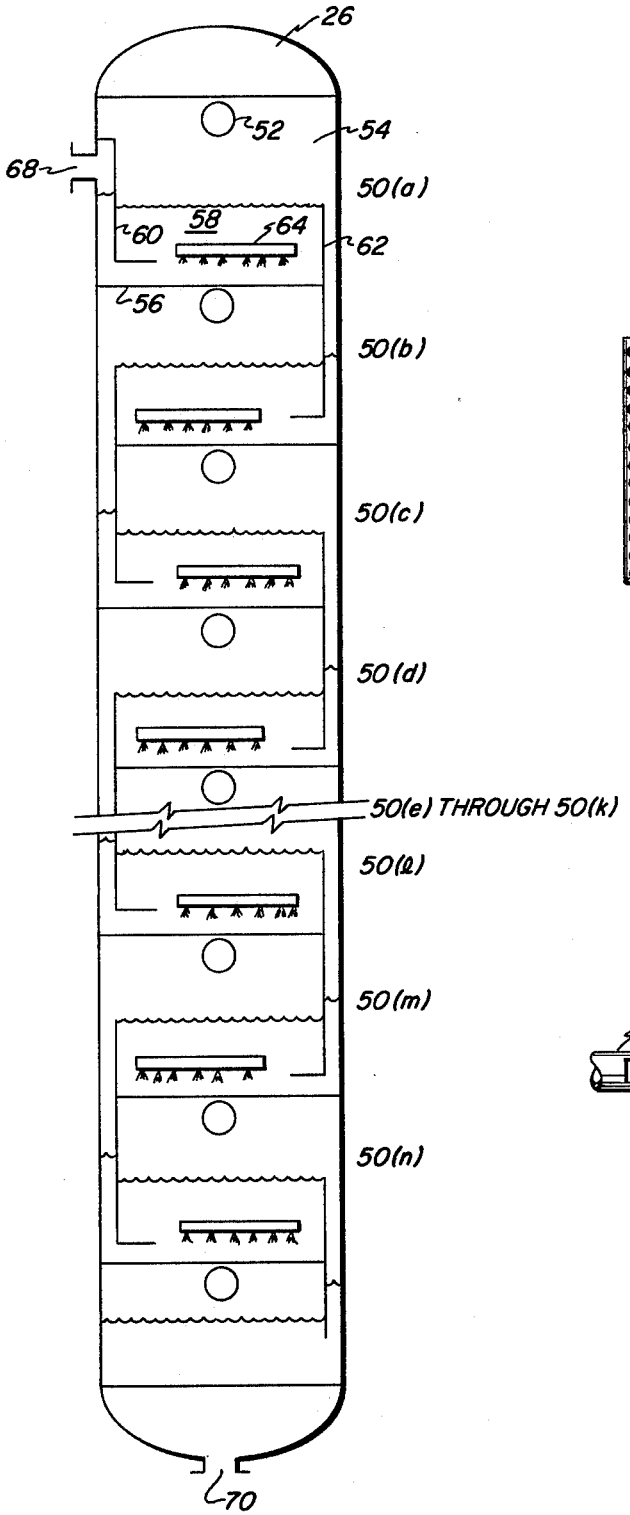
FIG. 2 (2(*a*), 2(*b*) and 2(*c*)) is a schematic diagram of a preferred embodiment of a multi-staged, vertical tower comprising the chilling zone of this invention.
Figure 2B:
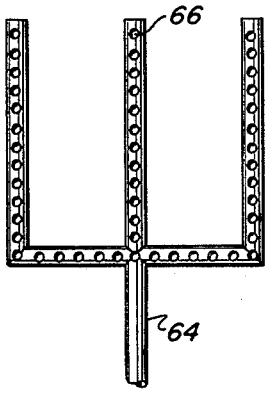
Figure 2C:
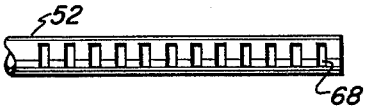

FIG. 2(*a*) illustrates a preferred embodiment of autorefrigerant chilling tower 26. The diameter of the tower is sized so as to provide a superficial vapor velocity low enough to avoid entrainment of the oil in the vapor. The tower comprises about 14 discrete stages, 50*a* through 50*n*. Each stage contains an autorefrigerant vapor collector, vapor space, slurry trays, slurry downcomer, weir and liquid autorefrigerant sparger. This is illustrated for stage 50*a* wherein 52 is the vapor collector, 54 represents the vapor space, 56 is the slurry tray, 58 is the slurry, 60 is the downcomer, 62 is the weir and 64 is the sparger. The sparger 64 and autorefrigerant vapor collector 52 are detailed in FIGS. 2-*b* and 2-*c*, respectively. Sparger 64 comprises piping containing a plurality of small holes 66. Vapor collector 52 is shown as a pipe containing a plurality of rectangular holes 68. In operation, slurry is fed to tower 26 via line 24, entering tower 26 through feed inlet 68 and passing through downcomer 60 wherein it is directed downward and under the surface of the slurry 58 held up on stage 50*a*. Liquid propylene is introduced into stage 50 from injection point 32 through sparger 64 and holes 66. The holes are sized so as to provide a level of agitation such that there is substantially instantaneous mixing (i.e., 1 second or less). The holes are directed downward, opposing slurry flow through the stage. Some of the propylene vaporizes as it enters the warmer slurry and the vapors bubble up through the slurry, with the remainder of the propylene going into solution. Propylene vapors are removed through vapor collector 52 and the cooled slurry flows over weir 62 wherein it enters downcomer 60 and is directed under the surface of the slurry on the next stage 50*b*. This process is repeated from stage to stage as the slurry passes down the tower until it exits from slurry outlet 70 at wax filtration temperature and fed to wax filter 42.

The invention will be more readily understood by reference to the following example:

EXAMPLE

This example provides laboratory data demonstrating the process of this invention. The feedstock used was a paraffinic, waxy distillate having a viscosity of 600 SUS at 100° F. (600N). A pilot plant autorefrigerant chilling unit was employed which comprised a vessel operating at a constant pressure of about 5 psig. Liquid propylene, at a temperature of about −30° F. was continuously injected into the unit below the surface of the slurry contained therein. Part of the liquid propylene vaporized with the vapors being continuously withdrawn from the constant pressure vapor space above the slurry. A slurry chilling rate of about 5° F./min. was maintained by controlling the rate of injection of the liquid propylene into the slurry. Before the feedstock was placed into the autorefrigerant chilling unit, it was mixed with a Paraflow/Acryloid dewaxing aid and prediluted with MEK at a temperature above it cloud point in an amount of one volume of MEK per volume of feed. The prediluted feed was then prechilled to a temperature of 120° F., which was approximately the cloud point of the prediluted feed, before being added to the unit. As hereinbefore stated, the prediluted feed was chilled in the autorefrigeration unit at a rate of 5° F./min. The waxy slurry formed in the unit was chilled down to a temperature of −30° F. and then filtered at −30° F. The amount of propylene that dissolved in the oil in the unit was 1.5 volumes per volume of feed oil.

The results of this experiment are contained in the Table. These results illustrate the operability of the present invention.

TABLE

CONTINUOUS CONSTANT PRESSURE AUTOREFRIGERATION DEWAXING

| | |
|---|---|
| Feedstock | 600N |
| Dewaxing Aid Type | P/A |
| Aid Dose, wt. % on Feed | 0.2 |
| Predilution Solvent | 100% MEK |
| Predilution Ratio on Feed | 1.0 |
| Prechilling Start °F. | 150 |
| Finish °F. | 120 |
| Rate °F. | 10.8 |
| Autorefrig. Pressure | 5 psig |
| Autorefrig. Start °F. | 120 |
| Finish °F. | −30 |
| Rate °F./Min. | 5 |
| $C_3$ Makeup to Chiller | Variable |
| Dilution to Filter | 2.5 |
| Solv. Comp. to Filter | 40/60 MEK/propylene |
| Filtration Temp. °F. | −30 |
| Feed Filter Rate GPHPSF | 5.0 |
| Wax L/S Ratio | 6.3 |
| Wax Oil Content, wt % | 62 |
| Mean Crystal Dia., Microns | 19 |
| Crystals <10 Microns, % | 3 |
| DWO Pour, °F. | 0 |

What is claimed is:

1. A continuous, autorefrigerant solvent dewaxing process for dewaxing waxy hydrocarbon oils which comprises the steps of:

(a) prediluting the waxy oil with a non-autorefrigerant dewaxing solvent to form a mixture of waxy oil and solvent;

(b) passing said mixture from step (a), at a temperature above its cloud point, into the top of a continuous, autorefrigerative chilling zone which comprises a vertical, elongated, multi-staged tower operating at a constant pressure wherein each stage contains a liquid spaced and a vapor space above the liquid space, each of said vapor spaces also containing means for removal of autorefrigerant vapor therefrom;

(c) cooling said mixture as it passes down from stage to stage in said chilling zone to precipitate wax from said oil thereby forming a slurry comprising solid particles of wax and a dewaxed oil/solvent solution and further chilling the so-formed slurry by contacting same, in said chilling zone, with a liquid autorefrigerant which in introduced under flow rate control conditions into a plurality of the stages in said zone and allowed to evaporate therein so as to achieve an average cooling rate of the slurry in said zone ranging from between about 0.1° to 20° F. per minute with an average temperature drop across each stage into which said liquid autorefrigerant is introduced and evaporated ranging from between about 2° to 20° F. and wherein the evaporated autorefrigerant is removed from each of said stages into which said liquid autorefrigerant was injected in a manner such that the autorefrigerant vapor formed in any given stage does not pass through all of the stages in the tower above said stage; and (d) separating the wax from the slurry to obtain wax and a dewaxed oil solution.

2. The process of claim 1 wherein said chilling zone operates at a constant pressure ranging from about 0 to 50 psig.

3. The process of claim 2 wherein said liquid autorefrigerant is selected from the group consisting essentially of normally gaseous $C_2$–$C_4$ hydrocarbons, ammonia and normally gaseous fluorocarbons.

4. The process of claim 3 wherein said prediluted waxy oil is at a temperature at or near its cloud point when it enters said chilling zone.

5. The process of claim 4 wherein said non-autoregrigerant predilution solvent comprises one or more solvents selected from the group consisting essentially of (a) $C_3$–$C_6$ aliphatic ketones, (b) $C_2$–$C_4$ alkyl chlorides and (c) mixtures of $C_3$–$C_6$ aliphatic ketones with one or more aromatic compounds including benzene, toluene, xylene and petroleum naphtha.

6. The process of claim 5 wherein said non-autorefrigerative solvent comprises one or more $C_3$–$C_6$ aliphatic ketones mixed with one or more aromatic compounds selected from the group consisting essentially of benzene, toluene, xylene, petroleum naphtha and mixture thereof.

7. The process of claim 6 wherein no more than 30 LV % of autorefrigerant, based on said waxy oil feed, is present in said first chilling zone.

8. The process of claim 7 wherein no autoregrigerant is present in said predilution solvent.

9. The process of claim 8 wherein said slurry is chilled down to wax filtration temperature in said chilling zone.

10. A continuous autorefrigerant process for solvent dewaxing waxy petroleum oil fractions which comprises the steps of:

(a) prediluting said waxy petroleum oil fraction with a non-autorefrigerant dewaxing solvent to form a mixture of waxy oil and solvent;

(b) passing said mixture from step (a), at a temperature above its cloud point, to the top of a continuous, autorefrigerative chilling zone which comprises a vertical, multi-staged tower operating at a constant pressure ranging between about 0 to 50 psig wherein each stage contains a liquid space, a vapor space above the liquid space and means for removing autorefrigerant vapor from each vapor space;

(c) cooling said mixture as it progresses down from stage to stage in said chilling zone to precipitate wax from said oil thereby forming a slurry comprising solid particles of wax and a dewaxed oil/solvent solution and further chilling the so-formed slurry by contacting same with a liquid autorefrigerant which is introduced under flow rate control conditions into a plurality of the stages in said chilling zone and allowed to evaporate therein at a controlled rate so as to achieve an average cooling rate of the slurry in said chilling zone ranging from between about 0.1° to 20° F./minute with an average temperature drop across each stage into which said liquid autorefrigerant is introduced into and evaporated in ranging from between about 2° to 20° F. and wherein the evaporated autorefrigerant is removed from each of said stages into which said liquid autorefrigerant was injected in a manner such that the autorefrigerant vapor formed in any given stage does not pass through all of the stages in said zone above said stage; and (d) filtering the wax from the slurry to obtain wax in a dewaxed oil solution.

11. The process of claim 10 wherein the predilution solvent comprises a ketone selected from the group consisting of (a) ketones having from 3 to 6 carbon atoms in the molecule and mixture thereof and (b) a mixture of 3 to 6 carbon atom ketones and aromatic compounds.

12. The process of claim 11 wherein the liquid autorefrigerant injected into the chilling zone is selected from the group consisting of from 2 to 4 carbon atom hydrocarbons, ammonia and normally gaseous chlorofluorocarbons.

13. The process of claim 12 wherein the ketone predilution solvent comprises a mixture of MEK/MIBK or MEK/toluene and the autorefrigerant is propylene or propane.

14. A continuous autorefrigerant process for solvent dewaxing wax-containing heavy petroleum oil fractions which contain at least about 10 wt. % of residual material having an initial boiling point of about 1050° F. which comprises the steps of:

(a) mixing said oil with a predilution solvent;

(b) passing said mixture to the top of a continuous, autorefrigerative chilling zone which comprises a vertical, multi-staged tower operating at a constant pressure ranging from between about 0 to 50 psig wherein each stage contains a liquid space, a vapor space above the liquid space and means for removing autorefrigerant vapor from each vapor space;

(c) cooling said mixture to precipitate wax therefrom to form a waxy slurry and precipitating additional wax from the so-formed slurry by contacting said mixture and slurry in said chilling zone with a liquid autorefrigerant which is introduced under flow rate control conditions into a plurality of the stages in said second zone and allowed to evaporate therein at a controlled rate so as to achieve an average cooling rate of the slurry in said second zone ranging from between about 0.1° to 20° F./minute and wherein the evaporated autorefrigerant is removed from each of said stages into which said liquid autorefrigerant was injected in a manner such that the autorefrigerant vapor found in any given stage does not pass through all of the stages in said zone above said stage; and (e) filtering the wax from the slurry to obtain wax in a dewaxed oil solution.

* * * * *